US011342105B2

(12) United States Patent
Inaba

(10) Patent No.: US 11,342,105 B2
(45) Date of Patent: May 24, 2022

(54) COIL, MAGNETIC CORE, AND REACTOR

(71) Applicants: AutoNetworks Technologies, Ltd., Mie (JP); Sumitomo Wiring Systems, Ltd., Mie (JP); Sumitomo Electric Industries, Ltd., Osaka (JP)

(72) Inventor: Kazuhiro Inaba, Mie (JP)

(73) Assignees: AutoNetworks Technologies, Ltd., Yokkaichi (JP); Sumitomo Wiring Systems, Ltd., Yokkaichi (JP); Sumitomo Electric Industries, Ltd., Osaka (JP)

( * ) Notice: Subject to any disclaimer, the term of this patent is extended or adjusted under 35 U.S.C. 154(b) by 470 days.

(21) Appl. No.: 16/334,617

(22) PCT Filed: Sep. 5, 2017

(86) PCT No.: PCT/JP2017/031940
§ 371 (c)(1),
(2) Date: Mar. 19, 2019

(87) PCT Pub. No.: WO2018/056047
PCT Pub. Date: Mar. 29, 2018

(65) Prior Publication Data

US 2021/0296042 A1 Sep. 23, 2021

(30) Foreign Application Priority Data

Sep. 21, 2016 (JP) ..... JP2016-184615

(51) Int. Cl.
*H01F 27/24* (2006.01)
*H01F 27/02* (2006.01)
(Continued)

(52) U.S. Cl.
CPC ..... *H01F 27/24* (2013.01); *H01F 27/022* (2013.01); *H01F 27/32* (2013.01); *H01F 37/00* (2013.01)

(58) Field of Classification Search
CPC ..... H01F 27/24; H01F 27/022; H01F 27/32; H01F 37/00; H01F 38/00; H01F 27/26; H01F 27/263; H01F 27/28; H01F 27/2847
See application file for complete search history.

(56) References Cited

U.S. PATENT DOCUMENTS 6,359,542 B1 * 3/2002 Widmayer ..... H01F 27/266 336/210
7,233,225 B2 * 6/2007 Sato ..... H01F 27/255 336/200
(Continued)

FOREIGN PATENT DOCUMENTS

JP 58044706 A * 3/1983 ..... H01F 27/255
JP 2003229314 A 8/2003
(Continued)

OTHER PUBLICATIONS

International Search Report, Application No. PCT/JP2017/031940, dated Nov. 28, 2017.

*Primary Examiner* — Mang Tin Bik Lian
(74) *Attorney, Agent, or Firm* — Honigman LLP

(57) ABSTRACT

A coil includes a tubular winding portion formed by winding a wire, wherein the winding portion includes two coil recessed portions that are provided such that recessed directions toward an inner space surrounded by an inner peripheral face of the winding portion are opposite to each other.

12 Claims, 4 Drawing Sheets

(51) Int. Cl.
*H01F 27/32* (2006.01)
*H01F 37/00* (2006.01)

(56) References Cited

U.S. PATENT DOCUMENTS

| | | | | |
|---|---|---|---|---|
| 9,324,492 | B2 * | 4/2016 | Heo | H01F 27/306 |
| 2006/0097837 | A1 * | 5/2006 | Yamasaki | H01F 30/06 336/208 |
| 2008/0129246 | A1 * | 6/2008 | Morita | H02J 50/10 320/108 |
| 2012/0044033 | A1 * | 2/2012 | Kawaguchi | H01F 27/263 336/90 |
| 2014/0160819 | A1 | 6/2014 | Inaba | |
| 2014/0218156 | A1 * | 8/2014 | Shinohara | H01F 5/04 336/192 |
| 2015/0287525 | A1 * | 10/2015 | Yamada | H01F 27/24 323/271 |
| 2017/0309395 | A1 * | 10/2017 | Shiraki | B60L 50/13 |
| 2017/0352476 | A1 | 12/2017 | Inaba et al. | |
| 2018/0061547 | A1 * | 3/2018 | Hanson | H01F 17/04 |

FOREIGN PATENT DOCUMENTS

| | | | |
|---|---|---|---|
| JP | 2006032663 | A | 2/2006 |
| JP | 2013232585 | A | 11/2013 |
| JP | 2013251451 | A | 12/2013 |
| JP | 2016100529 | A | 5/2016 |

* cited by examiner

COIL, MAGNETIC CORE, AND REACTOR

CROSS-REFERENCE TO RELATED APPLICATIONS

This application is the U.S. national stage of PCT/JP2017/031940 filed Sep. 5, 2017, which claims priority of Japanese Patent Application No. JP 2016-184615 filed Sep. 21, 2016, the contents of which are incorporated herein.

TECHNICAL FIELD

The present disclosure relates to a coil, a magnetic core, and a reactor.

BACKGROUND

A reactor is one type of component of a circuit for performing a voltage step-up operation or step-down operation. FIGS. 4 and 5 of JP 2016-122760A disclose a reactor for a vehicle-mounted converter, including: a coil having one rectangular tube-like winding portion formed by winding a wire into a spiral; and a magnetic core formed by combining a pair of E-shaped divided cores. This magnetic core includes an inner leg (an inner core portion 31) that is arranged along the inner periphery of the winding portion, a pair of side legs that are arranged along the outer periphery of the winding portion and sandwich the inner leg, and two connection portions that sandwich and couple the inner leg and the side legs.

There is a demand for reactors whose installation height is low and energy loss is low, and that have excellent heat dissipation properties. Furthermore, there is a demand for coils and magnetic cores with which such reactors can be constructed.

FIG. 4 of JP 2016-122760A shows a state in which the reactor is installed on an installation target, to which the reactor is to be attached, such that the axial direction of the winding portion of the coil is in parallel with a placement face of the installation target (hereinafter, this state may be referred to as a horizontal installation state). In the horizontal installation state, in particular, even when the number of turns of the winding portion is large, for example, the height of the reactor from the placement face (hereinafter, this height may be referred to as an installation height) can be made smaller than that in a case in which the reactor is installed such that the axial direction of the winding portion is orthogonal to the placement face of the installation target. Furthermore, in FIG. 4 of JP 2016-122760A, the lower face of the outer peripheral face of the winding portion, which is to be located on the installation target side, and the upper face that is on the side opposing the lower face are exposed without being covered by the magnetic core, and the lower face of the winding portion is positioned close to the placement face of the installation target. Accordingly, heat from the coil is likely to be transferred to the installation target, and is likely to dissipate into the surrounding air from the upper face of the winding portion, that is, this configuration has excellent heat dissipation properties.

However, if the height of the reactor shown in FIG. 4 of JP 2016-122760A is further reduced, there is a concern that the energy loss will increase as described below. That is to say, if the end face shape of the winding portion is changed to a horizontally long rectangular shape in order to reduce the installation height, and the shape of the inner leg is changed to a horizontally long rectangular shape in conformity with the horizontally long shape of the winding portion, the center-to-center distance between the inner leg and each side leg increases. As a result, in the horizontally long winding portion, the length of a portion that is not sandwiched between the inner leg and the side legs and is not covered by the magnetic core increases, and interaction of a leakage magnetic flux is likely to occur in such a portion. Interaction of a leakage magnetic flux may increase an eddy current loss in the coil.

For example, if the long side portions of the winding portion of the above-described horizontally long winding portion are sandwiched between the inner leg and the side legs, and the short side portions of the winding portion are exposed, interaction of a magnetic flux with the winding portion is reduced, and an increase in the energy loss can be easily reduced. However, since the side leg is interposed between the long side portion of the winding portion and the placement face of the installation target, the installation height increases by the thickness of the side leg, and heat dissipation properties from the coil to the installation target deteriorates.

It is an object of the present disclosure to provide a reactor whose installation height is low and energy loss is low, and that has excellent heat dissipation properties. Furthermore, another object thereof is to provide a coil and a magnetic core with which a reactor whose installation height is low and energy loss is low, and that has excellent heat dissipation properties, and the like can be constructed.

SUMMARY

The present disclosure is directed to a coil including a tubular winding portion formed by winding a wire, wherein the winding portion includes two coil recessed portions that are provided such that recessed directions toward an inner space surrounded by an inner peripheral face of the winding portion are opposite to each other.

The present disclosure is directed to a magnetic core including: an inner leg portion that is arranged along an inner periphery of a winding portion of a coil; two side leg portions that are arranged along an outer periphery of the winding portion and sandwich the inner leg portion; and two connection portions that sandwich and couple the inner leg portion and the side leg portions, wherein the inner leg portion includes: a protruding portion that is not sandwiched between the two side leg portions; and two core recessed portions that are provided such that recessed directions toward an inside of the inner leg portion are opposite to each other, and the side leg portions include projecting faces that respectively project toward the core recessed portions, and that are arranged with predetermined gaps respectively from the core recessed portions.

The present disclosure is directed to a reactor including the coil according to the present disclosure and the magnetic core according to the present disclosure, wherein the coil recessed portions are respectively arranged between the core recessed portions of the inner leg portion and the projecting faces of the side leg portions, and the portion of the winding portion other than the coil recessed portions is exposed without being covered by the magnetic core.

Advantageous Effects of Present Disclosure

With the coil of the present disclosure and the magnetic core of the present disclosure, a reactor whose installation height is low and energy loss is low, and that has excellent heat dissipation properties, and the like can be constructed. According to the reactor of the present disclosure, the installation height is low, the energy loss is low, and the heat dissipation properties are excellent.

DETAILED DESCRIPTION OF PREFERRED EMBODIMENTS

JP 2016-122760A

Figure 1:
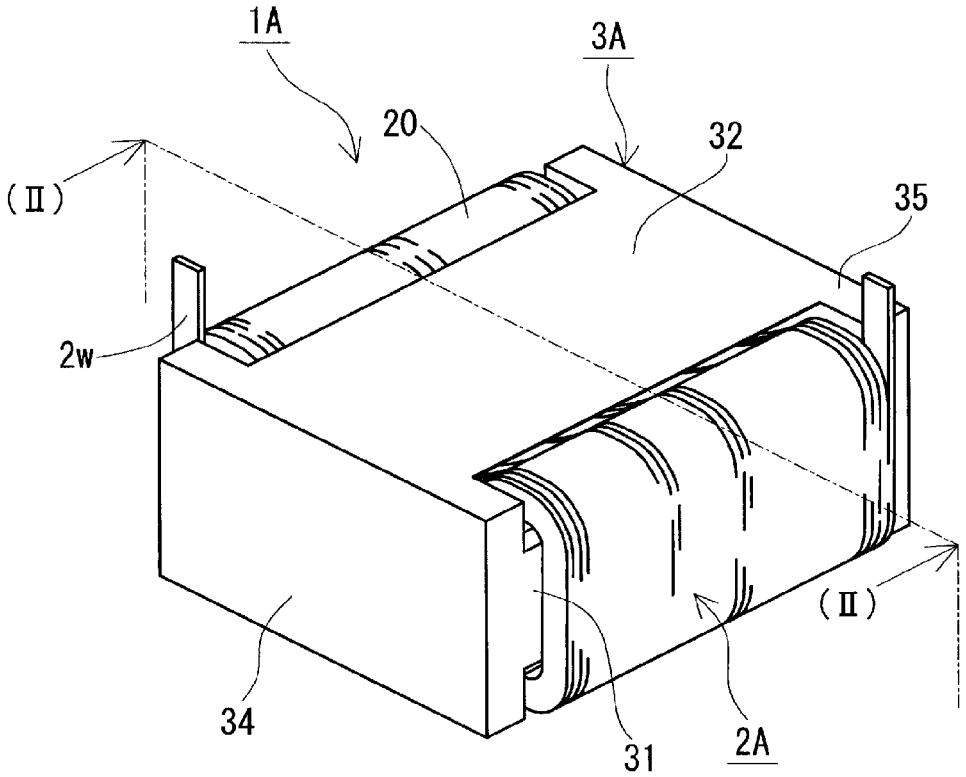
FIG. 1 is a schematic perspective view showing a reactor of Embodiment 1.

First, embodiments of the present disclosure will be listed and described.

A coil according to an embodiment of the present disclosure includes a tubular winding portion formed by winding a wire, wherein the winding portion includes two coil recessed portions that are provided such that recessed directions toward an inner space surrounded by an inner peripheral face of the winding portion are opposite to each other.

With the above-described coil, a reactor whose installation height is low and energy loss is low, and that has excellent heat dissipation properties, and the like can be constructed. A detailed description thereof is as follows.

In the above-described coil, the coil recessed portions of the winding portion can be used as arrangement portions of the magnetic core. If a magnetic core (in particular, a magnetic core described later in (5), etc.) is assembled with the above-described coil, and part of the magnetic core is arranged in the coil recessed portions, the coil recessed portions and part of the magnetic core are arranged so as to overlap each other, and thus the size of the combined body including the above-described coil and the magnetic core can be reduced. Accordingly, if the above-described coil is used, a reactor whose installation height is low, preferably in a horizontal installation state, and the like can be constructed.

In the above-described coil, if the coil recessed portions of the winding portion are used as arrangement portions of the magnetic core, and the portions of the winding portion other than the coil recessed portions are arranged as exposed portions that are not covered by the magnetic core, at least part of the exposed portions can be positioned close to a placement face of an installation target, and can be exposed to the surrounding air. Accordingly, if the above-described coil is used, a reactor that has excellent heat dissipation properties and the like can be constructed.

In the above-described coil, the coil recessed portions of the winding portion can be used as arrangement portions of the magnetic core, and the coil recessed portions can be sandwiched between the portion of the magnetic core arranged inside the winding portion and the portions thereof arranged in the coil recessed portions. Accordingly, even in the case in which the end face shape of the winding portion is horizontally long, and the coil recessed portions are relatively long, energy loss caused by interaction of a leakage magnetic flux can be easily reduced. Accordingly, if the above-described coil is used, a reactor whose energy loss is low and the like can be constructed.

Examples of the above-described coil can include a mode in which a ratio of a long side with respect to a short side of a rectangle that encapsulates an end face of the winding portion is 1.5 or more.

With this configuration, the coil that is flat can be installed in a horizontally long form. Thus, with this configuration, a reactor whose installation height is lower and the like can be constructed.

Examples of the above-described coil can include a mode in which the two coil recessed portions are arranged opposing each other.

With this configuration, for example, the coil has a symmetric shape in which the coil recessed portions face each other, and thus it is easy to form the coil, and to allow a magnetic flux to flow through the magnetic core in a well-balanced manner, compared with a case of an asymmetric shape. Thus, with this configuration, a reactor whose installation height is low and energy loss is low, and that has excellent heat dissipation properties, and the like can be constructed, and, furthermore, a reactor that has excellent manufacturability and also has excellent electromagnetic balance and the like can be constructed.

Examples of the above-described coil can include a mode further including a resin molded portion that covers at least part of an outer periphery of the coil.

With this configuration, the insulating properties with the magnetic core, the surrounding components, and the like can be improved. Thus, with this configuration, a reactor whose installation height is low and energy loss is low, and that has excellent heat dissipation properties, and the like can be constructed, and excellent insulating properties are obtained.

A magnetic core according to an embodiment of the present disclosure includes: an inner leg portion that is arranged along an inner periphery of a winding portion of a coil; two side leg portions that are arranged along an outer periphery of the winding portion and sandwich the inner leg portion; and two connection portions that sandwich and couple the inner leg portion and the side leg portions, wherein the inner leg portion includes: a protruding portion that is not sandwiched between the two side leg portions; and two core recessed portions that are provided such that recessed directions toward an inside of the inner leg portion are opposite to each other, and the side leg portions include projecting faces that respectively project toward the core recessed portions, and that are arranged with predetermined gaps respectively from the core recessed portions.

With the above-described magnetic core, a reactor whose installation height is low and energy loss is low, and that has excellent heat dissipation properties, and the like can be constructed. A detailed description thereof is as follows.

In the above-described magnetic core, gaps between the core recessed portions of the inner leg portion and the projecting faces of the side leg portions can be used as arrangement portions of the winding portion of the coil. If a coil (in particular, the coil described above in (1), etc.) is assembled with the above-described magnetic core, and the inner leg portion is inserted into the winding portion and part of the winding portion is arranged in the gaps, part of the magnetic core and part of the winding portion are arranged so as to overlap each other, and thus the size of the combined body including the above-described magnetic core and the coil can be reduced. Accordingly, if the above-described magnetic core is used, a reactor whose installation height is low and the like, preferably in an installation state in which the axial direction of the inner leg portion is in parallel with a placement face of an installation target (corresponding to the horizontal installation state), can be constructed.

In the above-described magnetic core, if gaps between the core recessed portions of the inner leg portion and the projecting faces of the side leg portions are used as arrangement portions of part of the winding portion, and the other portions of the winding portion are arranged so as to surround the protruding portions of the inner leg portion, the other portions of the winding portion can be arranged as exposed portions that are not covered by the magnetic core. For example, at least part of the exposed portions can be positioned close to a placement face of an installation target, and can be exposed to the surrounding air. Accordingly, if the above-described magnetic core is used, a reactor that has excellent heat dissipation properties and the like can be constructed.

In the above-described magnetic core, the inner leg portion includes recessed portions, but includes protruding portions, and thus a predetermined magnetic path area can be ensured. Furthermore, the side leg portions are provided so as to fill the core recessed portions of the inner leg portion, and there are portions in which the inner leg portion and the side leg portions are positioned close to each other, and thus a leakage magnetic flux can be reduced. Accordingly, even in the case in which the external appearance at a horizontal cross-section (described later) of the magnetic core is horizontally long, if part of the winding portion is arranged in gaps between the core recessed portions of the inner leg portion and the projecting faces of the side leg portions, energy loss caused by interaction of a leakage magnetic flux can be reduced, a reactor whose energy loss is low and the like can be constructed.

Examples of the above-described magnetic core can include a mode in which a ratio of a long side with respect to a short side of a rectangle that encapsulates a horizontal cross-section obtained by cutting the magnetic core along a plane that is orthogonal to an axial direction of the inner leg portion is 1.5 or more.

With this configuration, the magnetic core that is flat can be installed in a horizontally long form. Thus, with this configuration, a reactor whose installation height is lower and the like can be constructed.

Examples of the above-described magnetic core can include a mode in which the two core recessed portions are arranged opposing each other, and the two projecting faces are arranged opposing each other.

With this configuration, for example, the magnetic core has a symmetric shape in which the core recessed portions face each other and the projecting faces face each other on the outer side of the core recessed portions, and thus it is easy to form the magnetic core, and to allow a magnetic flux to flow through the magnetic core in a well-balanced manner, compared with a case of an asymmetric shape. Thus, with this configuration, a reactor whose installation height is low and energy loss is low, and that has excellent heat dissipation properties, and the like can be constructed, and, furthermore, a reactor that has excellent manufacturability and also has excellent electromagnetic balance and the like can be constructed.

Examples of the above-described magnetic core can include a mode including at least one of a molded body made of a composite material containing a magnetic powder and a resin, and a powder compact containing a magnetic powder.

With this configuration, it is possible to use an integrally molded body constituted by a molded body of a composite material, and a combined body obtained by combining a plurality of divided core pieces made of at least one of a molded body of a composite material and a powder compact, that is, the degree of freedom in selecting materials is high.

Examples of the above-described magnetic core can include a mode formed by combining a pair of divided core pieces, wherein each of the divided core pieces includes a connection portion on one side, and an inner leg piece that forms part of the inner leg portion and two side leg pieces that form part of the side leg portions, the pieces being provided standing upright from the connection portion.

With this configuration, it is easy to assemble the magnetic core with a coil, and the number of assembly components is small. Thus, with this configuration, a reactor whose installation height is low and energy loss is low, and that has excellent heat dissipation properties, and the like can be constructed, and it is easy to manufacture the reactor and the like.

A reactor according to an embodiment of the present disclosure includes the coil according to any one of (1) to (4) and the magnetic core according to any one of (5) to (9), wherein the coil recessed portions are respectively arranged between the core recessed portions of the inner leg portion and the projecting faces of the side leg portions, and the portion of the winding portion other than the coil recessed portions is exposed without being covered by the magnetic core.

The above-described reactor includes a coil with a specific shape having coil recessed portions and a magnetic core with a specific shape in which the inner leg portion has core recessed portions and the side leg portions have projecting faces, and the coil recessed portions are arranged between the core recessed portions of the inner leg portion and the projecting faces of the side leg portions. Since the coil recessed portions, the inner leg portion, and the side leg portions are arranged so as to overlap each other, the size of the above-described reactor can be reduced. Furthermore, in the above-described reactor, part of the winding portion (mainly, the coil recessed portions) is arranged as portions that are covered by the magnetic core, and the other portions of the winding portion (mainly, other than the coil recessed portions) are arranged as exposed portions that are not covered by the magnetic core. Accordingly, even in the case in which the winding portion and the magnetic core each have a horizontally long appearance, a leakage magnetic flux and energy loss caused thereby can be reduced, and heat from the coil can be allowed to efficiently dissipate. Accordingly, according to the above-described reactor, the installation height can be low preferably in a horizontal installation state, the energy loss is low, and the heat dissipation properties are excellent.

Examples of the above-described reactor can include a mode in which the side leg portions have a face that is flush with part of the portion of the winding portion exposed from the magnetic core.

With this configuration, portions of the winding portion that project from the magnetic core are small, and the installation height of the reactor that is smaller can be more easily reduced. Furthermore, with this configuration, if the flush faces of the winding portion are used as heat dissipation faces, superior heat dissipation properties can be obtained.

Hereinafter, embodiments of the present disclosure will be specifically described with reference to the drawings. Constituent elements with the same names are denoted by the same reference numerals in the drawings. Note that a reactor, a coil, and a magnetic core shown in the drawings will be described in a case in which their lower face is taken as an installation face that is to be placed on a placement face of an installation target. In the description below, in a state in which the reactor and the like are installed on an installation target, the direction that is along the axial direction of the winding portion of the coil may be referred to as a length direction, the direction that is orthogonal to the axial direction of the winding portion and that is in parallel with the placement face of the installation target may be referred to as a width direction, and the direction that is orthogonal to the placement face may be referred to as a height direction.

Embodiment 1

Figure 4:
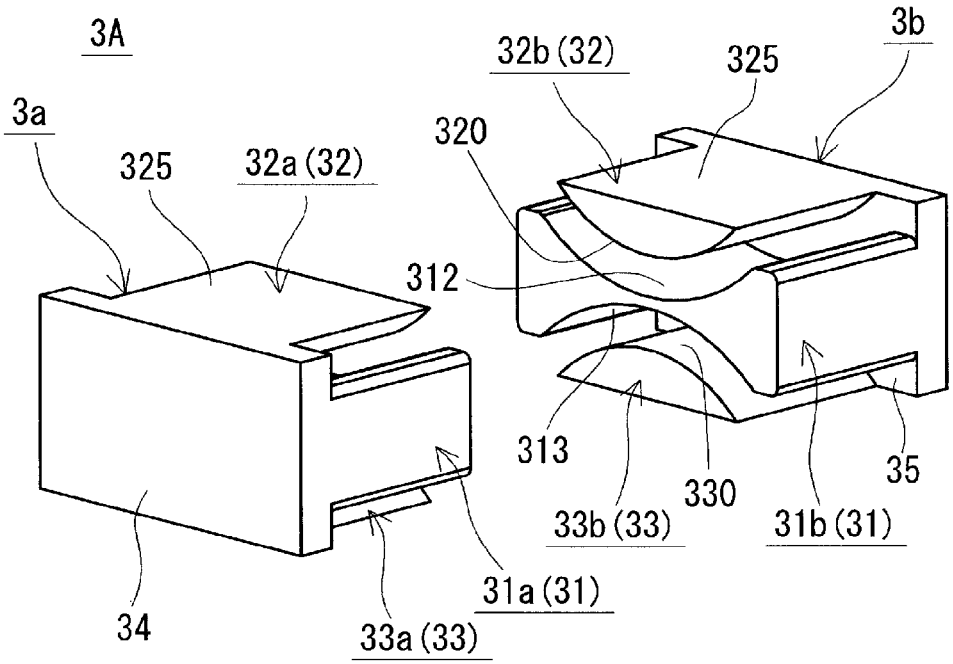
FIG. 4 is an exploded perspective view showing a magnetic core of Embodiment 1.
Figure 5:
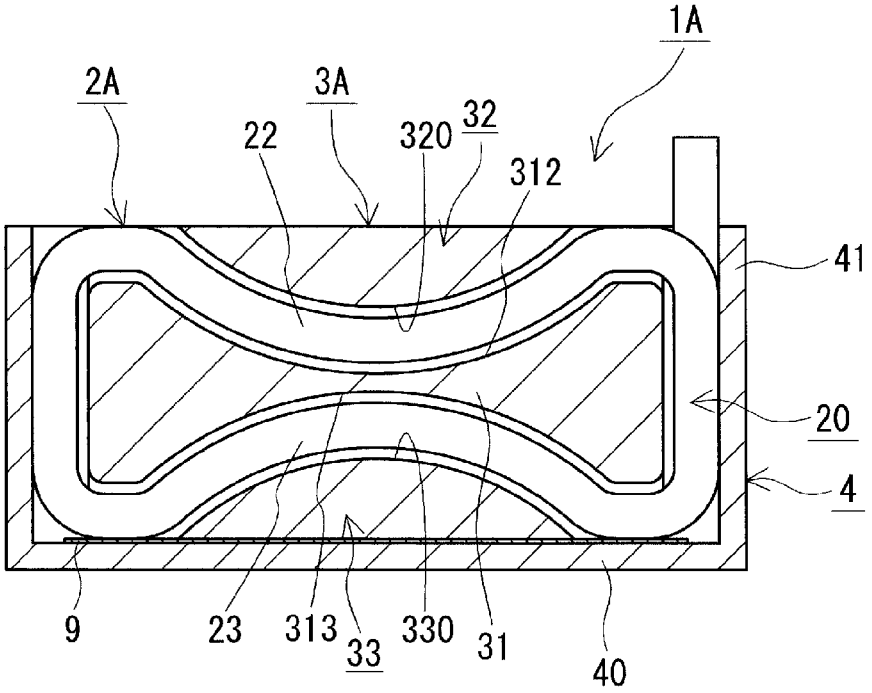
FIG. 5 is a horizontal cross-sectional view showing a state in which the reactor of Embodiment 1 is accommodated in a case.

Hereinafter, a reactor 1A, a coil 2A, and a magnetic core 3A of Embodiment 1 will be described with reference to FIGS. 1 to 5. FIGS. 2 and 5 are horizontal cross-sectional views of the reactor 1A taken along a plane that is orthogonal to the axial direction of the coil 2A.

Reactor

Figure 2:
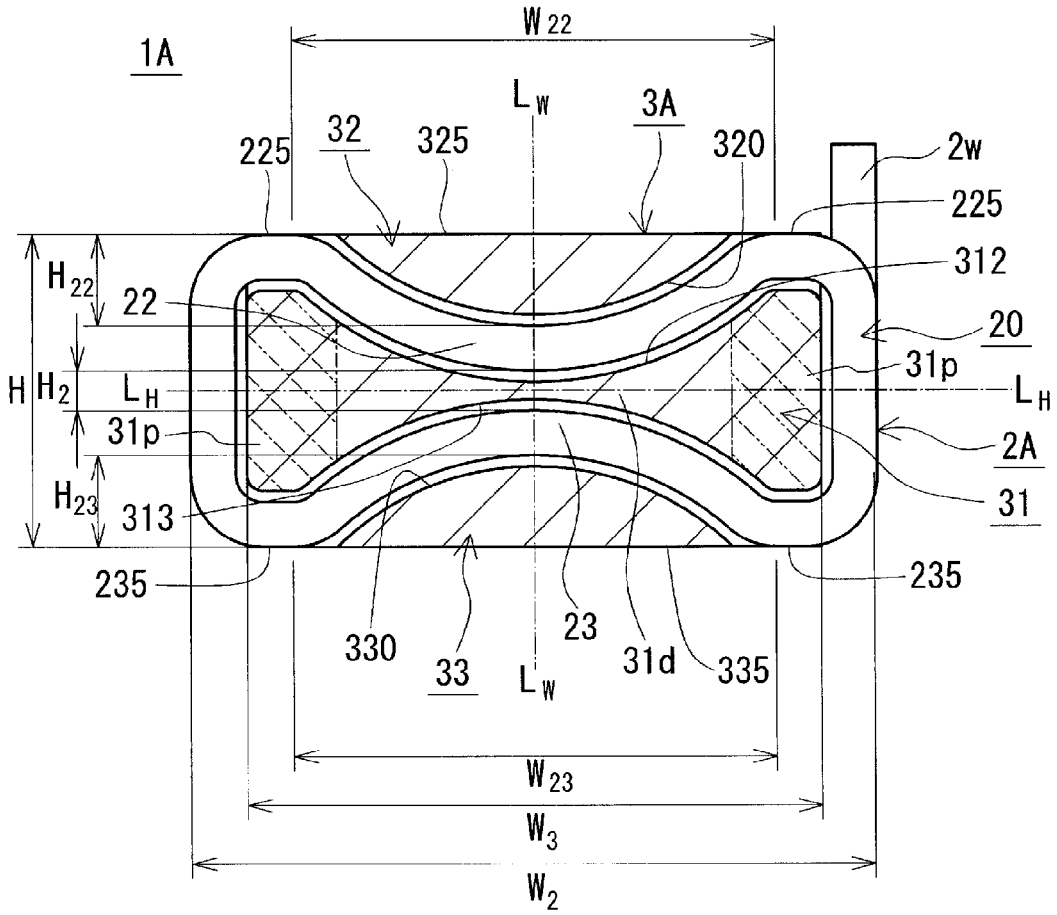
FIG. 2 is a cross-sectional view of the reactor of Embodiment 1 taken along the cut line (II)-(II) shown in FIG. 1.

As shown in FIG. 1, the reactor 1A of Embodiment 1 includes a coil 2A having one tubular winding portion 20 formed by winding a wire 2*w*, and a magnetic core 3A arranged inside and outside the coil 2A. As shown in FIG. 2, the magnetic core 3A includes an inner leg portion 31 that is arranged along the inner periphery of the winding portion 20 of the coil 2A, two side leg portions 32 and 33 that are arranged along the outer periphery of the winding portion 20 and sandwich the inner leg portion 31, and two connection portions 34 and 35 that sandwich the inner leg portion 31 and both side leg portions 32 and 33 and couple the inner leg portion 31 and the side leg portions 32 and 33 (FIGS. 1 and 4). In short, the magnetic core 3A is a combined body obtained by deforming a pair of E-shaped divided cores (FIG. 4). The reactor 1A in this example is used in a horizontal installation state in which the axial direction of the winding portion 20 (or the axial direction of the inner leg portion 31) is in parallel with a placement face of an installation target (not shown) such as a converter case.

Figure 3:
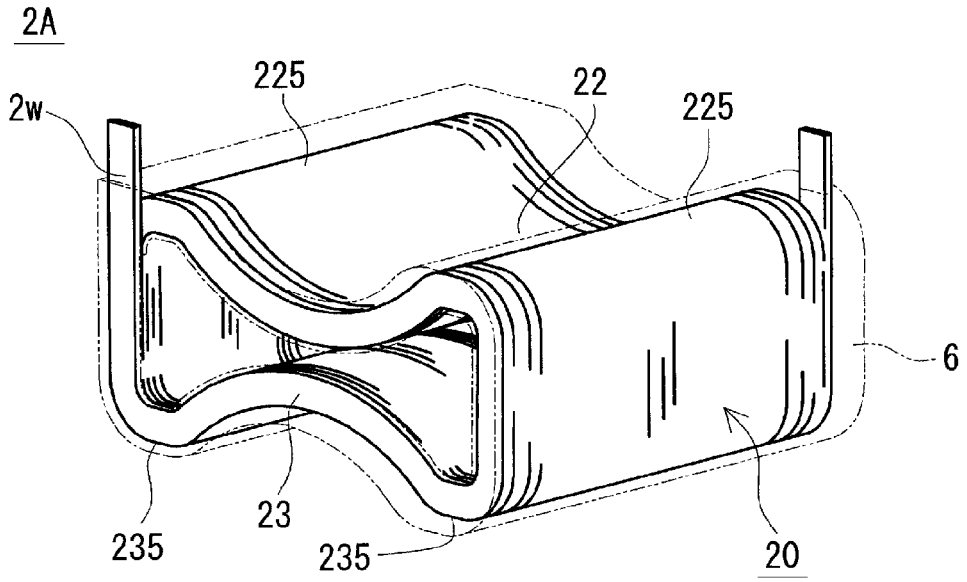
FIG. 3 is a schematic perspective view showing a coil of Embodiment 1.

The reactor 1A of Embodiment 1 includes the coil 2A of Embodiment 1 with a specific shape in which part of the tubular winding portion 20 is recessed inward as shown in FIG. 3. Furthermore, the reactor 1A of Embodiment 1 includes the magnetic core 3A of Embodiment 1 with a specific shape in which the inner leg portion 31 includes portions that are not sandwiched between the side leg portions 32 and 33 (protruding portions 31*p*) as shown in FIG. 2, and part of the inner leg portion 31 is recessed inward and the side leg portions 32 and 33 project toward the recesses of the inner leg portion 31 as shown in FIG. 4. Furthermore, in the reactor 1A of Embodiment 1, as shown in FIG. 2, the recessed portions (coil recessed portions 22 and 23) of the winding portion 20 are arranged as portions that are sandwiched between the recessed portions (the core recessed portions 312 and 313) of the inner leg portion 31 and projecting portions (projecting faces 320 and 330) of the side leg portions 32 and 33 and that are covered by the magnetic core 3A, and the portions of the winding portion 20 other than the recessed portions are arranged as portions that are not covered by the magnetic core 3A. Hereinafter, each constituent element will be described in detail.

Coil

As shown in FIG. 3, the coil 2A of Embodiment 1 includes the tubular winding portion 20 formed by winding one wire 2*w* into a spiral. The winding portion 20 includes two coil recessed portions 22 and 23 that are provided such that the recessed directions toward the inner space surrounded by the inner peripheral face are opposite to each other. In this example, the two coil recessed portions 22 and 23 are arranged opposing each other. FIGS. 2 and 3 show a case in which the recessed direction of the coil recessed portion 22 is the downward orientation, the recessed direction of the coil recessed portion 23 is the upward orientation, and the coil recessed portions are recessed in totally opposite directions at the same position in the width direction of the winding portion 20 (the left-right direction in FIG. 2).

The winding portion 20 in this example has a horizontally long appearance that is encapsulated in a horizontally long rectangular parallelepiped. The winding portion 20 is a ribbon-like tubular member whose height is small at the middle in the width direction, with long-side regions of the tubular member in the shape of a horizontally long rectangular parallelepiped being each recessed inward, and increases away from the middle in the width direction. When assembling the magnetic core 3A to the coil 2A, the inner space is used as an arrangement portion of the inner leg portion 31 and the coil recessed portions 22 and 23 are used as arrangement portions of the side leg portions 32 and 33, so that the coil recessed portions 22 and 23 are sandwiched between the inner leg portion 31 and the side leg portions 32 and 33, and portions other than the coil recessed portions 22 and 23 are exposed from the magnetic core 3A.

Wire

The wire 2*w* in this example is a coated wire including a conductor made of copper or the like, and an insulating coating made of an insulating material such as polyamide imide around the outer periphery of the conductor, and is a rectangular wire whose horizontal cross-sectional shape is rectangular. The winding portion 20 in this example is an edgewise coil. Note that the wire 2*w* may be a wire with various shapes such as a round wire. If the wire 2*w* forms a rectangular edgewise coil as in this example, the size can be easily reduced (in particular, the length can be easily shortened) by increasing the space factor, and the outer peripheral face of the winding portion 20 is likely to be flat as shown in FIG. 3, compared with a case in which the wire forms a round wire coil. For example, the coil recessed portions 22 and 23 are formed as circular arc faces, and installation faces 235 that are to be located on the lower side in an installation state, opposing faces 225 that are to be located on the upper side and oppose the installation faces 235, and side faces that are positioned on both sides in the width direction are formed as flat faces (see FIG. 2).

The ends of the wire 2*w* that are continuous with the winding portion 20 and are arranged at the end face sides of the winding portion 20 are used as portions that are to be connected to an external apparatus such as a power source. FIG. 3 shows a case in which the ends of the wire 2*w* are drawn out upward away from the winding portion 20, but the drawing direction, the drawing length, and the like may be changed as appropriate.

Coil Recessed Portions

The coil recessed portions 22 and 23 in this example are each in the shape of a circular arc (FIG. 2), but the shape can be changed as appropriate. If the coil recessed portions 22 and 23 are each in the shape of a circular arc as in this example, angular portions in the winding portion 20 can be reduced, and it is easy to manufacture the coil 2A. Furthermore, angular portions in the magnetic core 3A also can be reduced in conformity with the winding portion 20, and thus cracks and the like are unlikely to occur, and excellent assembly workability is expected.

As shown in FIG. 2, the coil recessed portions 22 and 23 in this example have the same shape and the same size, are formed at the same position in the width direction, and are formed at positions in the height direction that are symmetric about a center line $L_H$ in the height direction. Accordingly, the winding portion 20 has end face shapes and horizontal cross-sectional shapes that are each symmetric about a center line $L_W$ in the width direction, and symmetric about the center line $L_H$ in the height direction. It is also possible that the coil recessed portions 22 and 23 have different shapes, sizes (bending radii, projecting heights to the inside of the winding portion 20, etc.), formation positions, and the like, so that the winding portion 20 has end face shapes and horizontal cross-sectional shapes that are each asymmetric about a line (see Embodiment 2 below). If the winding portion 20 has end face shapes and horizontal cross-sectional shapes that are each symmetric about a line, it is easy to form the coil 2A, and to allow a magnetic flux to flow through the magnetic core 3A in a well-balanced manner, compared with a case of an asymmetric shape. The size of the coil recessed portions 22 and 23, the distance between the coil recessed portions 22 and 23, and the like can be selected as appropriate. This example shows a case in which the inner peripheral faces of the coil recessed portions 22 and 23 are not in contact with each other, and there is a predetermined gap $H_2$ at the middle in the width direction of the winding portion 20 (the shortest distance between the coil recessed portions 22 and 23 in this example), and the distance between the opposing regions of the inner peripheral face of the winding portion 20 increases from the middle toward both sides in the width direction. It is possible that each of opening widths $W_{22}$ and $W_{23}$ of the coil recessed portions 22 and 23 is approximately 20% or more and 90% or less of a width $W_2$ of the winding portion 20, and each of largest depths $H_{22}$ and $H_{23}$ of the coil recessed portions 22 and 23 is approximately 10% or more and less than 50% of a height H of the winding portion 20.

Aspect Ratio

Quantitatively, the horizontally long winding portion 20 refers to a portion in which, assuming a rectangle that encapsulates an end face of the winding portion 20, a ratio of a long side with respect to a short side of this virtual rectangle (corresponding to width $W_2$/height H, in this example) is more than 1. In particular, if the ratio is 1.5 or more, the installation height of the reactor 1A is likely to be relatively small. If the ratio is larger, the height can be more easily reduced, and thus the ratio is preferably 1.8 or more, and more preferably 2.0 or more (2.0 or more, in this example). If the ratio is too large, the manufacturability of the coil 2A and the like deteriorate, and thus, in consideration of manufacturability, the ratio is preferably approximately 4.0 or less. If the absolute value of a length (height H) of a short side is smaller, the installation height can be made smaller.

Manufacturing Method

Examples of the methods for manufacturing the coil 2A including the coil recessed portions 22 and 23 include a method in which a tubular member including the coil recessed portions 22 and 23 is formed by winding the wire 2*w* into a spiral, and a method in which, for example, quadrangular tubular member or a cylindrical member is formed by winding the wire 2*w* into a spiral, after which the coil recessed portions 22 and 23 are formed through pressing or the like at predetermined positions on the tubular member.

Other Configurations

The coil 2A may include a resin molded portion 6 that covers at least part of the outer periphery of the winding portion 20. In FIG. 3, the resin molded portion 6 that covers substantially the entire portions inside and outside the winding portion 20 is shown by a virtual line (dashed double dotted line), but it is also possible that at least part of the inner peripheral face, the outer peripheral face, and the end faces of the winding portion 20 is exposed without being covered. For example, if the portions of the winding portion 20 exposed from the magnetic core 3A are exposed also from the resin molded portion 6, the heat dissipation properties can be easily improved. Alternatively, for example, if at least part of the inner peripheral face of the winding portion 20 and at least part of the end faces of the winding portion 20 are covered by the resin molded portion 6, the insulating properties between the coil 2A and the magnetic core 3A can be improved. Even in the case in which the resin molded portion 6 is not included, it is possible to improve the insulating properties between the coil 2A and the magnetic core 3A by using the above-described coated wire as the wire 2*w*.

Examples of the constituent material of the resin molded portion 6 include insulating resins such as thermoplastic resins and thermosetting resins. Examples of the thermoplastic resins include polyphenylene sulfide (PPS) resins, polytetrafluoroethylene (PTFE) resins, liquid crystal polymers (LCP), polyamide (PA) resins (e.g., nylon 6 and nylon 66), polybutylene terephthalate (PBT) resins, and acrylonitrile-butadiene-styrene (ABS) resins. Examples of the thermosetting resins include unsaturated polyester resins, epoxy resins, urethane resins, and silicone resins. The insulating resins may contain a non-magnetic and non-metal powder of a material such as alumina or silica. In this case, the heat dissipation properties, the insulating properties, and the like can be improved.

Magnetic Core

As shown in FIG. 4, the magnetic core 3A of Embodiment 1 is such that the inner leg portion 31 is interposed between the side leg portions 32 and 33, and the side leg portion 32, the inner leg portion 31, and the side leg portion 33 are overlapped in this order and are sandwiched between the two connection portions 34 and 35 that are arranged opposing each other. The inner leg portion 31 includes two core recessed portions 312 and 313 that are provided such that their recessed directions are opposite to each other, and the side leg portions 32 and 33 include projecting faces 320 and 330 that respectively project toward the core recessed portions 312 and 313 and that are arranged with predetermined gaps respectively from the core recessed portions 312 and 313. In this example, as shown in FIG. 2, the two core recessed portions 312 and 313 are arranged opposing each other, and the two projecting faces 320 and 330 are arranged opposing each other. FIG. 2 shows a case in which the recessed direction of the core recessed portion 312 and the projecting direction of the projecting face 320 are downward directions, the recessed direction of the core recessed portion 313 and the projecting direction of the projecting face 330 are upward directions, and the core recessed portions 312 and 313 are recessed and the projecting faces 320 and 330 project at the same position in the width direction of a horizontal cross-section of the magnetic core 3A. In addition, the magnetic core 3A in this example has a horizontally long appearance that is encapsulated in a horizontally long rectangular parallelepiped (FIG. 1).

The inner leg portion 31 includes an interposed portion 31*d* that is sandwiched between the two side leg portions 32 and 33, and protruding portions 31*p* that are not sandwiched between the two side leg portions 32 and 33. The aspect of including the protruding portions 31*p* is one of differences from a conventional E-shaped magnetic core in which the width of an inner leg is the same as or smaller than the width of side legs. In FIG. 2, the protruding portions 31*p* are cross-hatched for easy understanding.

In the magnetic core 3A, a gap between the core recessed portion 312 and the projecting face 320 is used as an arrangement portion of the coil recessed portion 22, a gap between the core recessed portion 313 and the projecting face 330 is used as an arrangement portion of the coil recessed portion 23, and the protruding portions 31*p* of the inner leg portion 31 are used as arrangement portions of the winding portion 20 other than the coil recessed portions 22 and 23. Accordingly, when the coil 2A and the magnetic core 3A are assembled, the coil recessed portions 22 and 23 are covered by the magnetic core 3A, and portions other than the coil recessed portions 22 and 23 are exposed from the magnetic core 3A (FIGS. 1 and 2).

Constituent Materials

The magnetic core 3A may include a molded body made of a composite material containing a magnetic powder and a resin. Examples of particles of the magnetic powder include particles made of a soft magnetic metal or a soft magnetic non-metal, coated particles in which the outer surfaces of soft magnetic metal particles are covered by an insulating coating made of phosphate or the like. Examples of the soft magnetic metal include iron group metal such as pure iron, and ion-based alloys (an Fe—Si alloy, an Fe—Ni alloy, etc.), and examples of the soft magnetic non-metal include ferrite.

In the composite material, the magnetic powder may be contained in an amount of 30 vol % or more and 80 vol % or less, and the resin may be contained in an amount of 10 vol % or more and 70 vol % or less. In order to improve the saturated magnetic flux density and the heat dissipation properties, the magnetic powder is contained in an amount of preferably 50 vol % or more, more preferably 55 vol % or more, and even more preferably 60 vol % or more. In order to improve the flowability during the manufacturing process, the magnetic powder is contained in an amount of preferably 75 vol % or less, and more preferably 70 vol % or less, and the resin is contained in an amount of preferably more than 30 vol %.

Examples of the resin in the composite material include thermosetting resins and thermoplastic resins in the above description of the resin molded portion 6, and further include room-temperature curable resins, and low-temperature curable resins, and the like. It is also possible to use BMC (bulk molding compound) in which calcium carbonate or glass fibers are mixed in unsaturated polyester, millable type silicone rubber, millable type urethane rubber, and the like.

In addition to the magnetic powder and the resin, the composite material may contain a non-magnetic and non-metal powder of a material such as alumina or silica. The non-magnetic and non-metal powder is contained in an amount of preferably 0.2 mass % or more and 20 mass % or less, more preferably 0.3 mass % or more and 15 mass % or less, and even more preferably 0.5 mass % or more and 10 mass % or less.

The molded body of the composite material can be manufactured using an appropriate molding method such as injection molding or cast molding. For example, it is possible to manufacture an integrally molded magnetic core 3A, by accommodating the coil 2A in a mold or a case 4 (FIG. 5), and filling the inside and the outside of the coil 2A with the composite material in a fluid state. If a mold with an appropriate shape is used, it is possible to manufacture divided core pieces constituted by a molded body of the composite material. The molded body of the composite material can be easily molded even in the case in which it has a complex shape, and excellent manufacturability is obtained.

Alternatively, the magnetic core 3A may include a powder compact containing a magnetic powder. Typical examples of the powder compact include a compact obtained by compression-molding a mixture powder containing a magnetic powder and a binder into a predetermined shape, and a compact obtained by further performing heat treatment after molding. Examples of the binder include resins and the like, and the binder may be contained in an amount of approximately 30 vol % or less. With the heat treatments, a binder may disappear, or thermal denaturation may occur. If a mold with an appropriate shape is used, it is possible to manufacture divided core pieces constituted by a powder compact. A larger amount of magnetic powder can be contained in the powder compact than in the molded body of the composite material, and thus a magnetic core with a high saturated magnetic flux density can be easily constructed.

Alternatively, the magnetic core 3A may include a stacked body obtained by stacking soft magnetic plates such as silicon steel plates, a sintered body such as a ferrite core, and the like.

The magnetic core 3A may include a gap member or an air gap. Examples of the gap member include a member made of a non-magnetic material such as alumina, a member obtained by mixing a magnetic material and a non-magnetic material, wherein the relative permeability is lower than that of a molded body such as divided core pieces. If the magnetic core 3A contains a molded body of the composite material or the like, and magnetic saturation is unlikely to occur, a magnetic gap such as a gap member or an air gap can be omitted, or a magnetic gap can be reduced. In this case, the energy loss caused by a leakage magnetic flux at a magnetic gap portion is likely to decrease, and the coil 2A and the magnetic core 3A can be arranged close to each other, so that the size can be easily made smaller.

Molded State

The magnetic core 3A may be an integrally molded body. In this case, it is easy to manufacture the magnetic core 3A, if the magnetic core 3A is constituted by a molded body of the composite material as described above. Furthermore, in this case, it is easy to maintain the shape of the coil 2A, the coil 2A includes the resin molded portion 6, for example. FIG. 4 shows a state similar to that in which the magnetic core 3A that is an integrally molded body is cut along a plane that is orthogonal to the axial direction of the inner leg portion 31, and the cut pieces are arranged apart from each other.

Alternatively, the magnetic core 3A may be a combined body obtained by combining a plurality of divided core pieces. The number of divided pieces, the shape of each divided core piece, the constituent material, and the like can be selected as appropriate. FIG. 4 shows a state in which the magnetic core 3A is formed by combining a pair of divided core pieces 3*a* and 3*b*. The divided core piece 3*a* on one side includes the connection portion 34 on one side, and an inner leg piece 31*a* that forms one part of the inner leg portion 31 and two side leg pieces 32*a* and 33*a* that form one part of the side leg portions 32 and 33, which are provided standing upright from the connection portion 34. The divided core piece 3*b* on the other side includes the connection portion 35 on the other side, and an inner leg piece 31*b* that forms another part of the inner leg portion 31 and two side leg pieces 32*b* and 33*b* that form another part of the side leg portions 32 and 33, which are provided standing upright from the connection portion 35. If the divided core pieces 3*a* and 3*b* have the same shape and the same size, and have shapes that are symmetric to each other as shown in FIG. 4, excellent manufacturability is obtained. Furthermore, in the case of using a combined body obtained by combining a pair of divided core pieces 3*a* and 3*b*, the number of assembly steps is small, and thus the reactor 1A has excellent assembly workability. The magnetic core 3A may have either a mode including divided core pieces that are made of different materials (e.g., a mode including a divided core piece constituted by a molded body of the composite material and a divided core piece constituted by a powder compact, etc.), or a mode including divided core pieces all of which are made of the same material.

Inner Leg Portion, Side Leg Portions, and Connection Portions

As shown in FIG. 4, the inner leg portion 31 in this example is a ribbon-like columnar member whose height increases away from the middle in the width direction, with long-side regions in a horizontally long rectangular parallelepiped being each recessed inward. The recessed portions are the core recessed portions 312 and 313. The inner leg portion 31 includes circular arc faces that form the core recessed portions 312 and 313, and side faces that are arranged on both sides in the width direction and constituted by rectangular planes. The circular arc faces have the same shape and the same size.

The side leg portions 32 and 33 in this example are columnar members having the same shape and the same size, having circular arc projecting faces 320 and 330 that are along the core recessed portions 312 and 313 and have dome-like end faces and horizontal cross-sections. The side leg portion 33 that is to be located on the installation target side has an installation face 335 constituted by a rectangular plane (FIG. 2). The side leg portion 32 that is to be located on the side away from an installation target is arranged opposing the installation face 335, and has an opposing face 325 constituted by a rectangular plane.

The connection portions 34 and 35 in this example are thin rectangular parallelepipeds having the same shape and the same size, and have the same width as the width $W_3$ of the inner leg portion 31 (FIG. 2) and the same height as the height H of the winding portion 20 (FIG. 2). The side faces of the connection portions 34 and 35 and the side faces of the inner leg portion 31 are provided flush with each other (FIG. 4). The installation faces (the lower faces in FIGS. 2 and 4) of the connection portions 34 and 35 and the installation face 335 of the side leg portion 33 (FIG. 2) are provided flush with each other. The opposing faces (the upper faces in FIGS. 2 and 4) that are arranged opposing the installation face in the connection portions 34 and 35 are provided flush with the opposing face 325 of the side leg portion 32 (FIG. 2). That is to say, when the magnetic core 3A is viewed in the axial direction of the inner leg portion 31, the inner leg portion 31 and the side leg portions 32 and 33 are provided so as not to project from the connection portions 34 and 35 (FIG. 1).

The magnetic core 3A in this example has a horizontal cross-sectional shape that is symmetric about the center line $L_W$ in the width direction, and symmetric about the center line $L_H$ in the height direction, as shown in FIG. 2 (the same applies to end face shapes of the divided core pieces 3*a* and 3*b*).

Core Recessed Portions and Projecting Faces

The core recessed portions 312 and 313 and the projecting faces 320 and 330 in this example are each in the shape of a circular arc, but the shape can be changed as appropriate. Typical examples of the shape and the size of the core recessed portions 312 and 313 and the projecting faces 320 and 330 include a shape and a size that conform to the shape of the coil 2A that is to be assembled with the magnetic core 3A, in particular, the shape of the coil recessed portions 22 and 23. If the magnetic core 3A is an integrally molded body, it is possible to obtain a magnetic core 3A including the core recessed portions 312 and 313 and the projecting faces 320 and 330 that conform to the coil recessed portions 22 and 23, by manufacturing the magnetic core 3A along the coil 2A. If the magnetic core 3A is a combined body obtained by combining a plurality of divided core pieces, it is preferable to adjust the shape, the size, the arrangement positions, and the like of the inner leg portion 31 and the side leg portions 32 and 33 such that gaps that are large enough to accommodate the coil recessed portions 22 and 23 between the core recessed portion 312 and the projecting face 320 and between the core recessed portion 313 and the projecting face 330 (e.g., gaps that are slightly larger than the width of the wire 2*w*). In the case in which the magnetic core 3A is a combined body obtained by combining divided core pieces, if the core recessed portions 312 and 313 and the projecting faces 320 and 330 are each in the shape of a circular arc as in this example, angular portions can be reduced, and thus cracks and the like are unlikely to occur when assembly to the coil 2A, and excellent assembly workability is expected.

Interposed Portion and Protruding Portions

The width $W_3$ of the inner leg portion 31 in this example is longer than the width of the side leg portions 32 and 33 as shown in FIG. 2. The middle (the interposed portion 31*d*) in the width direction of the inner leg portion 31 is sandwiched between the side leg portions 32 and 33 that are positioned on the upper and lower sides in FIG. 2. Both ends (the protruding portions 31*p*) in the width direction of the inner leg portion 31 are not sandwiched between the side leg portions 32 and 33, and project outward in the width direction from the side leg portions 32 and 33. When viewed in a direction that is orthogonal to the opposing face 325 of the side leg portion 32 (or the installation face 335 of the side leg portion 33), the portion of the inner leg portion 31 that overlaps both side leg portions 32 and 33 is taken as the interposed portion 31*d*, and the portions thereof that do not overlap are taken as the protruding portions 31*p*. The interposed portion 31*d* in this example is a region that is sandwiched between straight lines (indicated by dashed double dotted lines in FIG. 2) that are orthogonal to the opposing face 325 and the installation face 335 of the side leg portions 32 and 33 and that pass through the ends in the width direction of the side leg portions 32 and 33. The formation lengths in the width direction of the interposed portion 31*d* and the protruding portions 31*p* can be selected as appropriate. If the formation length of the interposed portion 31*d* is larger, an increase in the energy loss caused by a leakage magnetic flux can be more easily reduced. If the formation portions of the protruding portions 31*p* are larger, exposed portions can be more easily ensured by increasing the regions of the winding portion 20 that are arranged along the protruding portions 31*p*, and heat dissipation properties can be easily improved. It is possible that the formation length of the interposed portion 31*d* is, for example, approximately 1% or more and 80% or less of the width $W_3$ of the inner leg portion 31, and the formation lengths of the protruding portions 31*p* (the total length of the two portions) is, for example, approximately 20% or more and 80% or less of the width $W_3$ of the inner leg portion 31.

Aspect Ratio

Quantitatively, the horizontally long magnetic core 3A refers to a portion in which, assuming a rectangle that encapsulates a horizontal cross-section obtained by cutting the magnetic core 3A along a plane that is orthogonal to the axial direction of the inner leg portion 31, a ratio of a long side with respect to a short side of this virtual rectangle (corresponding to width $W_3$/height H, in this example) is more than 1. In particular, if the ratio is 1.5 or more, the installation height of the reactor 1A is likely to be relatively small. If the ratio is larger, the height can be more easily reduced, and thus the ratio is preferably 1.6 or more, and more preferably 1.8 or more (1.8 or more, in this example). If the ratio is too large, the manufacturability of the magnetic core 3A and the like deteriorate, and thus, in consideration of manufacturability, the ratio is preferably approximately 4.0 or less. If the absolute value of a length (height H) of a short side is smaller, the installation height can be made smaller.

Reactor

The reactor 1A of Embodiment 1 includes the coil 2A of Embodiment 1 and the magnetic core 3A of Embodiment 1 described above. In particular, the reactor 1A of Embodiment 1 is such that the coil recessed portions 22 and 23 of the winding portion 20 of the coil 2A are respectively arranged in circular arc gaps that are provided between the core recessed portions 312 and 313 of the inner leg portion 31 and the projecting faces 320 and 330 of the side leg portions 32 and 33 (FIG. 2), and portions other than the coil recessed portions 22 and 23 are exposed without being covered by the magnetic core 3A (FIG. 1).

Even in the case in which the winding portion 20 has a horizontally long appearance and the coil recessed portions 22 and 23 are relatively long as in this example, if the winding portion 20 is sandwiched between the inner leg portion 31 and the side leg portions 32 and 33, a magnetic flux from the winding portion 20 is likely to pass through the magnetic core 3A, and a magnetic flux that interacts with the winding portion 20 can be easily reduced.

The portions of the winding portion 20 exposed from the magnetic core 3A are portions surrounding the protruding portions 31*p* of the inner leg portion 31, and include the installation faces 235, the opposing faces 225, and the side faces, wherein these faces can be used as heat dissipation faces to the outside. For example, when a cooling mechanism is arranged close to a side face of the winding portion 20, the side face can be used as a heat dissipation face.

The side leg portions 32 and 33 in this example include faces that are flush with part of the portions of the winding portion 20 exposed from the magnetic core 3A. Specifically, the installation face 335 of the side leg portion 33 is flush with the installation faces 235 of the winding portion 20. Accordingly, the installation face of the reactor 1A is constituted by the winding portion 20, and the side leg portion 33 and the connection portions 34 and 35 of the magnetic core 3A. For example, when the reactor 1A is installed on a placement face of an installation target including a cooling mechanism, the installation faces 235 of the winding portion 20 can be used as heat dissipation faces, and heat is allowed to dissipate to the installation target. In this example, the opposing face 325 of the side leg portion 32 and the opposing faces 225 of the winding portion 20 are also flush with each other. Accordingly, the reactor 1A has a rectangular parallelepiped-like appearance that is flat as a whole as shown in FIG. 1.

In addition, the reactor 1A may include the case 4 that accommodates a combined body including the coil 2A and the magnetic core 3A as shown in FIG. 5. The case 4 may be a box-like member including a bottom portion 40 that supports the installation face of the reactor 1A, and a wall portion 41 that is provided standing upright from the bottom portion 40. If the shape and the size of the case 4 are a shape and a size that conform to the combined body, the reactor 1A can be in a small size even including the case 4. If the constituent material of the case 4 is a metal such as aluminum or an aluminum alloy, effects are expected such as that the case 4 can be used as a heat dissipation path, that mechanical protection can be easily provided due to excellent strength, and the like. FIG. 5 shows the case 4 made of metal and having a shape and a size in which an installation face of the combined body is positioned close to the inner bottom face of the case 4 and side faces of the combined body (the side faces of the winding portion 20, in this example) are positioned close to the inner wall faces of the case 4. If the combined body and the case 4 made of metal are positioned close to each other, heat of the coil 2A can be efficiently transferred to the case 4.

Furthermore, as shown in FIG. 5, the reactor 1A may include a heat dissipation layer 9 between the combined body including the coil 2A and the magnetic core 3A and the inner bottom face of the case 4. The heat dissipation layer 9 is made of a material that has excellent heat dissipation properties, and improves the thermal conductivity from the coil 2A to the case 4. Specific examples of the material include a material containing fillers that have excellent heat dissipation properties (non-magnetic and non-metal powder such as alumina) and a resin, which may be used in the form of a sheet or the like. If the heat dissipation layer 9 contains an adhesive, the combined body can be fixed to the case 4 via the heat dissipation layer 9. It is also possible to omit at least one of the case 4 and the heat dissipation layer 9.

Applications

The reactor 1A of Embodiment 1 can be used as constituent components of various converters, such as vehicle-mounted converters (typically, DC-DC converters) mounted on vehicles such as hybrid cars, plug-in hybrid cars, electric vehicles, fuel cell vehicles, and the like, and converters for air conditioners, and electric power converting apparatuses. In particular, the reactor 1A of Embodiment 1 can be preferably used as a constituent component that is for high current application (100 A or more or 150 A or more), that is required to have excellent heat dissipation properties, and whose height is required to be reduced. The coil 2A of Embodiment 1 and the magnetic core 3A of Embodiment 1 can be used as constituent elements of the reactor 1A and the like.

Main Effects

The reactor 1A of Embodiment 1 has a horizontally long appearance, and thus its installation height can be reduced in a horizontal installation state. In particular, if the reactor 1A of Embodiment 1 includes the coil 2A of Embodiment 1 having the coil recessed portions 22 and 23, and the magnetic core 3A of Embodiment 1 having the core recessed portions 312 and 313 and the projecting faces 320 and 330, it is possible reduce the installation height, to reduce energy loss, and to obtain excellent heat dissipation properties, due to the following reasons (1) to (3).

Since the coil recessed portions 22 and 23 of the winding portion 20 are arranged between the core recessed portions 312 and 313 of the inner leg portion 31 and the projecting faces 320 and 330 of the side leg portions 32 and 33 in the magnetic core 3A, and part of the winding portion 20 and part of the magnetic core 3A are arranged so as to overlap each other when viewed in the height direction, the height can be reduced.

Since the inner leg portion 31 of the magnetic core 3A is provided with the protruding portions 31*p*, and the portions of the winding portion 20 surrounding the protruding portions 31*p* are arranged as exposed portions that are not covered by the magnetic core 3A, the exposed portions can be used as heat dissipation portions of the coil 2A.

Since the inner leg portion 31 of the magnetic core 3A includes the protruding portions 31*p* and the interposed portion 31*d*, the magnetic path area can be ensured, and a leakage magnetic flux can be reduced. As a result, a magnetic flux that interacts with the winding portion 20 can be reduced.

In addition, the reactor 1A in this example has the following effects.

Since part of the exposed portions of the winding portion 20 and part of the side leg portions 32 and 33 are flush with each other, the height H can be easily reduced, and the installation height can be further reduced.

Since the exposed portions of the winding portion 20 include faces in three directions, i.e., the installation faces 235, the opposing faces 225, and the side faces, the faces can be used as heat dissipation faces, the heat dissipation properties can be further improved.

Since the coil 2A is such that the coil recessed portions 22 and 23 are arranged opposing each other and have shapes that are symmetric to each other, and the magnetic core 3A is such that the core recessed portions 312 and 313 and the projecting faces 320 and 330 are arranged opposing each other and have shapes that are symmetric to each other, the coil 2A and the magnetic core 3A have excellent manufacturability and also have excellent electromagnetic balance.

Embodiment 2

Figure 6:
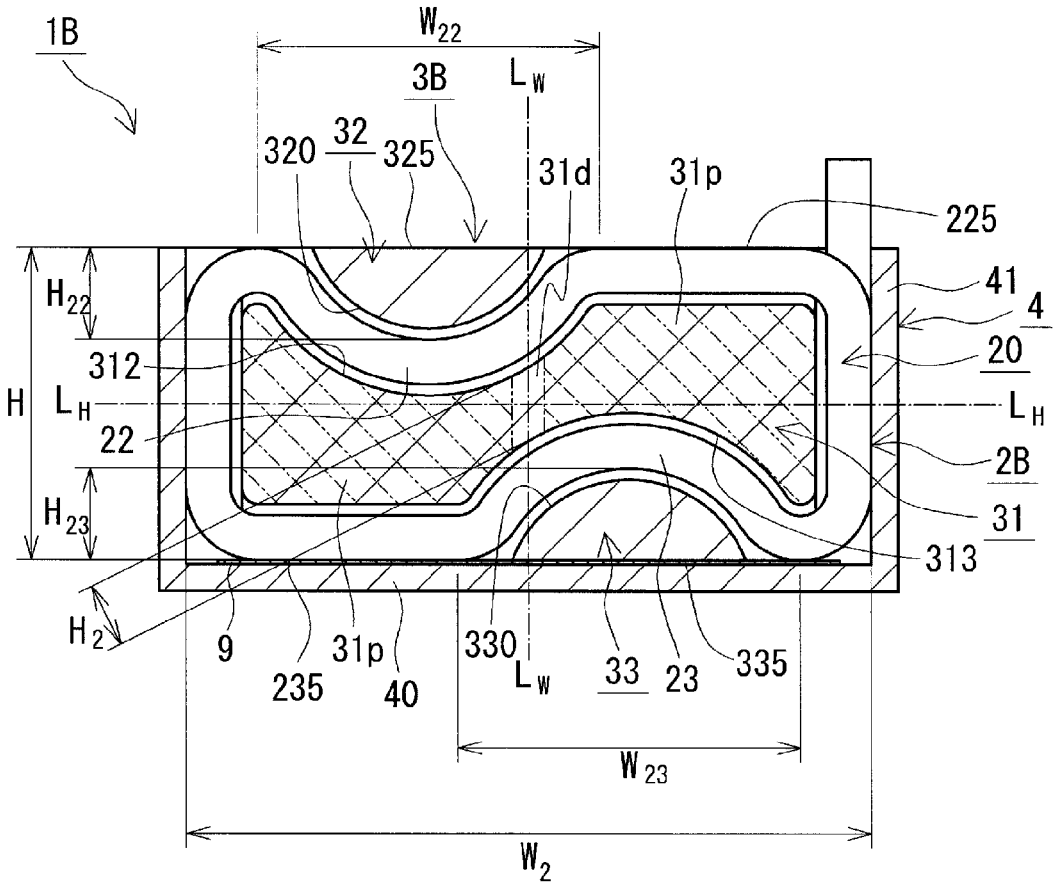
FIG. 6 is a horizontal cross-sectional view showing a reactor of Embodiment 2.

Hereinafter, a reactor 1B of Embodiment 2 will be described with reference to FIG. 6. FIG. 6 is a horizontal cross-sectional view obtained by cutting the reactor 1B along a plane that is orthogonal to the axial direction of a coil 2B.

The basic configuration of the reactor 1B of Embodiment 2 is similar to that of the reactor 1A of Embodiment 1. That is to say, the reactor 1B has a horizontally long appearance, and thus its installation height can be reduced in a horizontal installation state. The reactor 1B includes the coil 2B of Embodiment 2 in which the winding portion 20 has the coil recessed portions 22 and 23, and a magnetic core 3B of Embodiment 2 in which the inner leg portion 31 has the core recessed portions 312 and 313 and the side leg portions 32 and 33 have the projecting faces 320 and 330. The reactor 1B of Embodiment 2 is different from Embodiment 1 mainly in that the coil recessed portions 22 and 23 are arranged at different positions in the width direction of the winding portion 20, and the core recessed portions 312 and 313 and the projecting faces 320 and 330 are also arranged at different positions in the width direction of the winding portion 20 in conformity with the shape of the winding portion 20. Hereinafter, the aspect regarding this difference will be described in detail, and a detailed description of the configuration, the effects, and the like that are the same as those in Embodiment 1 has been omitted.

In the coil 2B of Embodiment 2, the coil recessed portion 22 is positioned closer to one side (the left side in FIG. 6) in the width direction of the winding portion 20, and the coil recessed portion 23 is positioned closer to the other side (the right side in FIG. 6). That is to say, the coil recessed portions 22 and 23 are substantially diagonally positioned. Accordingly, portions of the coil recessed portions 22 and 23 oppose each other, but the other portions thereof do not oppose each other. FIG. 6 shows a case in which the recessed direction of the coil recessed portion 22 is the downward orientation, the recessed direction of the coil recessed portion 23 is the upward orientation, and the coil recessed portions are recessed in totally opposite directions at different positions on the left and right sides in the width direction of the winding portion 20.

Since the coil recessed portions 22 and 23 are formed at different positions in the width direction, the installation face 235 and the opposing face 225 of the coil 2B are likely to have a larger area than that of the coil 2A of Embodiment 1. In the coil 2A of Embodiment 1, the installation faces 235 and the opposing faces 225 with a relatively small area are arranged on both sides of the coil recessed portions 22 and 23 as shown in FIG. 2. On the other hand, in the coil 2B of Embodiment 2, each of the installation face 235 and the opposing face 225 is constituted by one continuous face as shown in FIG. 6, and thus a large area can be ensured. From this aspect, a further improvement of the heat dissipation properties can be expected.

In the magnetic core 3B of Embodiment 2, the core recessed portion 312 is positioned closer to one side (the left side in FIG. 6) in the width direction of the inner leg portion 31, and the projecting face 320 of the side leg portion 32 is also positioned on that side in conformity with the position of the core recessed portion 312. The core recessed portion 313 is positioned closer to the other side (the right side in FIG. 6) in the width direction of the inner leg portion 31, and the projecting face 330 of the side leg portion 33 is also positioned on that side in conformity with the position of the core recessed portion 313. The core recessed portions 312 and 313 are substantially diagonally positioned, and the projecting faces 320 and 330 are also diagonally positioned in conformity with the positions of the core recessed portions 312 and 313. Accordingly, portions of the core recessed portions 312 and 313 oppose each other, but the other portions thereof do not oppose each other. Also, portions of the projecting faces 320 and 330 oppose each other, but the other portions thereof do not oppose each other. FIG. 6 shows a case in which the recessed direction of the core recessed portion 312 and the projecting direction of the projecting face 320 are downward directions, the recessed direction of the core recessed portion 313 and the projecting direction of the projecting face 330 are upward directions, and the core recessed portions 312 and 313 are recessed and the projecting faces 320 and 330 project in totally opposite directions at different positions on the left and right sides in the width direction of a horizontal cross-section of the magnetic core 3B. The installation face 335 of the side leg portion 33 and the installation face 235 of the winding portion 20 are flush with each other, and the opposing face 325 of the side leg portion 32 and the opposing face 225 of the winding portion 20 are flush with each other.

In FIG. 6, the protruding portions 31*p* are cross-hatched for easy understanding. Since the core recessed portions 312 and 313 are formed at different positions in the width direction, the width of the interposed portion 31*d* in the inner leg portion 31 that is sandwiched between the two side leg portions 32 and 33 is smaller than that in the magnetic core 3A of Embodiment 1, and the width of the protruding portions 31*p* in the inner leg portion 31 that are not sandwiched between the two side leg portions 32 and 33 is larger than that in the magnetic core 3A of Embodiment 1. Accordingly, the exposed portions of the winding portion 20 arranged so as to surround the protruding portions 31*p* can be easily ensured in a large area, and the heat dissipation properties can be improved.

The reactor 1B of Embodiment 2 includes the coil 2B of Embodiment 2 having the coil recessed portions 22 and 23 and the magnetic core 3B of Embodiment 2 having the core recessed portions 312 and 313 and the projecting faces 320 and 330 as in Embodiment 1, and thus it is possible reduce the installation height, to reduce the energy loss, and to obtain excellent heat dissipation properties. In particular, the exposed portions of the winding portion 20 in the reactor 1B of Embodiment 2 can be easily ensured in a large area, and thus superior heat dissipation properties can be obtained.

Modified Examples

At least one of the following modifications or additions can be applied to Embodiments 1 and 2 above.

To include a sensor (not shown) for measuring physical values regarding the reactor, such as a temperature sensor, a current sensor, a voltage sensor, and a magnetic flux sensor.

To include a heat dissipation plate on an exposed portion of the winding portion 20 (e.g., a side face of the winding portion 20, etc.).

To include an insulating interposed member such as a bobbin instead of the resin molded portion 6.

To include a heat-fusible resin portion (not shown) for joining adjacent turns constituting the winding portion 20, instead of the resin molded portion 6 or in addition to the resin molded portion 6.

To include a sealing resin for sealing the combined body including the coil 2A and the magnetic core 3A in the case 4.

Note that the present disclosure is not limited to these examples, and is specified by the scope of claims. All changes that come within the meaning and range of equivalency of the claims are intended to be embraced therein.

For example, the installation state may be a state other than the horizontal installation state. Examples thereof include an installation state in which the axial direction of the winding portion 20 is orthogonal to an installation face of an installation target, that is, an installation state obtained by rotating the state shown in FIG. 2 rightward or leftward by 90° such that a short-side side face is arranged as an installation face. With these configurations, a reactor whose energy loss is low and the like can be obtained. Furthermore, with these configurations, excellent heat dissipation properties are expected depending on the state in which a cooling mechanism is arranged.

The invention claimed is:

1. A coil comprising a tubular winding portion formed by winding a wire, wherein the winding portion includes two coil recessed portions, each of the two recessed portions defined by a recess in a direction along a height of the coil so as to be toward an inner space surrounded by an inner peripheral face of the winding portion, wherein the two recessed portions are opposite to each other so as to be drawn toward each other, the wire includes a conductor made of a rectangular wire, and an installation face having a flat surface and an opposing face of the winding portion, and side faces that are orthogonal to the installation face that are positioned on both sides in a width direction of the winding portion include portions formed as flat faces.

2. A magnetic core comprising:

an inner leg portion that is arranged along an inner periphery of a winding portion of a coil;

two side leg portions that are arranged along an outer periphery of the winding portion and sandwich the inner leg portion;

and two connection portions that sandwich and couple the inner leg portion and the side leg portions, wherein the inner leg portion includes:

a protruding portion that is not sandwiched between the two side leg portions; and two core recessed portions defined by a recess in a direction toward an inside of the inner leg portion, the two core recessed portions are opposite to each other so as to be drawn together, and the side leg portions include a projecting face and an opposing face that is planar and opposite of the projecting face, the projecting face project toward the core recessed portions, and that are arranged with predetermined gaps respectively from the core recessed portions so as to accommodate a height of the winding portion of the coil, the winding portion is wound around the inner leg portion so as to place an inner peripheral surface of the winding portion against the outer surface of the inner leg portion.

3. The magnetic core according to claim 2, wherein a ratio of a long side with respect to a short side of a rectangle that encapsulates a horizontal cross-section obtained by cutting the magnetic core along a plane that is orthogonal to an axial direction of the inner leg portion is 1.5 or more.

4. The magnetic core according to claim 2, wherein the two core recessed portions are arranged opposing each other, and the two projecting faces are arranged opposing each other.

5. The magnetic core according to claim 2, wherein at least one of a molded body made of a composite material containing a magnetic powder and a resin, and a powder compact containing a magnetic powder.

6. The magnetic core according to claim 2, formed by combining a pair of divided core pieces, wherein each of the divided core pieces includes a connection portion on one side, and an inner leg piece that forms part of the inner leg portion and two side leg pieces that form part of the side leg portions, the pieces being provided standing upright from the connection portion.

7. A reactor comprising: a coil comprising a tubular winding portion formed by winding a wire, wherein the winding portion includes two coil recessed portions, each of the two recessed portions defined by a recess in a direction along a height of the wire so as to be toward an inner space surrounded by an inner peripheral face of the winding portion are opposite to each other and drawn toward each other; and the magnetic core according to claim 5, wherein the coil recessed portions are respectively arranged between the core recessed portions of the inner leg portion and the projecting faces of the side leg portions, and the portion of the winding portion other than the coil recessed portions is exposed without being covered by the magnetic core.

8. The reactor according to claim 7, wherein the side leg portions have a face that is flush with part of the portion of the winding portion exposed from the magnetic core.

9. The reactor according to claim 7, wherein a ratio of a long side with respect to a short side of a rectangle that encapsulates an end face of the winding portion is 1.5 or more.

10. The reactor according to claim 7, wherein the two coil recessed portions are arranged opposing each other.

11. The reactor according to claim 7, further comprising a resin molded portion that covers at least part of the outer periphery of the winding portion.

12. The reactor according to claim 7, wherein the wire includes a conductor made of a rectangular wire, and an installation face and an opposing face of the winding portion, and side faces that are positioned on both sides in a width direction of the winding portion include portions formed as flat faces.

* * * * *